US006213041B1

(12) United States Patent
Kojima et al.

(10) Patent No.: US 6,213,041 B1
(45) Date of Patent: Apr. 10, 2001

(54) SPEED SENSOR FOR PERSONAL WATERCRAFT

(75) Inventors: Yazukazu Kojima; Sumihiro Takashima, both of Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/300,417

(22) Filed: Apr. 26, 1999

(30) Foreign Application Priority Data

Apr. 24, 1998 (JP) ..... 10-115794

(51) Int. Cl.[7] ..... B63B 35/00
(52) U.S. Cl. ..... 114/55.5; 440/2; 440/38
(58) Field of Search ..... 490/84–87, 1, 490/2, 38–42; 114/55.5, 55.55; 73/187; 324/174

(56) References Cited

U.S. PATENT DOCUMENTS

| | | | | |
|---|---|---|---|---|
| 3,164,016 | | 1/1965 | Dinsmore . | |
| 3,349,615 | | 10/1967 | Finkl . | |
| 4,070,909 | | 1/1978 | Carpenter . | |
| 4,100,877 | | 7/1978 | Scott et al. . | |
| 4,644,788 | * | 2/1987 | Boucher | 73/187 |
| 5,176,548 | | 1/1993 | Morgan . | |
| 5,187,978 | | 2/1993 | Tendler . | |
| 5,244,425 | | 9/1993 | Tasaki et al. . | |
| 5,295,877 | | 3/1994 | Kanno . | |
| 5,369,360 | | 11/1994 | Amyot . | |
| 5,433,635 | | 7/1995 | Kobayashi . | |
| 5,606,253 | * | 2/1997 | Boucher et al. | 324/174 |
| 5,699,749 | | 12/1997 | Yamada et al. . | |
| 5,894,087 | | 4/1999 | Ohtuka et al. . | |

OTHER PUBLICATIONS

Bombardier, Inc., *Sea:Doo 1997 Parts Catalog, GTS 5818, GTI 5641,* Canada, 1996, pages A1, A2, D5 (and associated drawing).
Bombardier, Inc., *Sea:Doo 1997 Parts Catalog, GSX 5624,* Canada, 1997, pages A1, A2, C3 (and associated drawing).
Bombardier, Inc., *Sea:Doo 1997 Parts catalog, XP 5662,* Canada, 1997, pages A1, A2, C8 (and associated drawing).

* cited by examiner

*Primary Examiner*—Ed Swinehart
(74) *Attorney, Agent, or Firm*—Knobbe, Martens, Olson & Bear, LLP

(57) ABSTRACT

A watercraft having a speed measuring system which provides for accurate and consistent measurement of watercraft speed throughout the operation of the watercraft, including during violent maneuvers and/or sharp turns. The speed measuring system includes a ride plate assembly for a personal watercraft comprising a sensor and a plate. The sensor generally includes a moveable element and a housing supporting at least a portion of the moveable element. The plate includes a longitudinally-extending channel with the channel extending along at least a portion of the length of the plate. The housing is connected to an aft portion of the plate with at least a portion of the rotatable element being positioned in line with the channel.

30 Claims, 10 Drawing Sheets

SPEED SENSOR FOR PERSONAL WATERCRAFT

BACKGROUND OF THE INVENTION

1. Field of the Invention

The present invention generally relates to a sensor device for use with a personal watercraft. More particularly, the present invention relates to a speed monitoring system adapted to be mounted to a ride plate of a personal watercraft.

2. Description of Related Art

Personal watercraft have become very popular in recent years. An enthusiasm for competition has grown with this popularity, and as a result personal watercraft have become increasingly fast. Many personal watercraft today are capable of speeds well in excess of 60 miles per hour. This type of watercraft is sporting in nature; it turns swiftly, is easily maneuverable, and accelerates quickly. Personal watercraft today commonly carry one rider and one or two passengers.

Personal watercraft often include some types of instrumentation to optimize the performance of the watercraft, as well as to monitor various operational characteristics of the watercraft's performance. In this regard, the personal watercraft usually includes a speedometer to allow the operator to monitor the speed of the watercraft.

Most speed indicators require a component of the indicator to be mounted on the underside of the hull. In this position, the component lies within the water and generates a signal indicative of the watercraft's speed. The hull of a personal watercraft, however, does not have large areas on which to mount conventional speed sensors. Most of the practical surface on the underside of the hull is occupied by a jet pump unit that is positioned within a tunnel formed on the underside of the watercraft hull.

As a result of the limited space on the underside of the hull, speed indicators are usually mounted proximate to the stern of the watercraft, near a nozzle section of the jet pump unit. This location of the speed indicator, however, often results in an overly complicated layout of the watercraft components, including the speed sensor, steering nozzle and associated level and cable arrangements. In addition, the speed indicator extends below the planing surface of the lower hull at this location and consequently is susceptible to damage. Moreover, the speed indicator is also visible from the rear of the watercraft when mounted at this location, which lessens the attractive, streamlined appearance of the watercraft. In addition, the speed sensor will often give false readings resulting from the disturbances the watercraft hull causes as it travels through the water.

SUMMARY OF THE INVENTION

The present invention involves in part the recognition that several problems arise in connection with employing a speed sensor with a personal watercraft. One such problem involves the fact that the watercraft disturbs the water in which it travels, which can result in false readings from a speed sensor attached to the watercraft. Another problem involves the fact that, as the watercraft maneuvers, much of the bottom surface of the watercraft can often lift out of the water, which can similarly affect speed readings from the attached speed sensor.

The present invention provides a speed measuring system whereby the speed of the watercraft can be accurately measured during watercraft operation, even when the watercraft is travelling at high speeds and/or undergoing violent maneuvers or sharp turns.

Accordingly, one aspect of the present invention involves a personal watercraft comprising a hull having a longitudinal axis. A generally longitudinally-extending elongated seat is positioned on an aft portion of the hull. An engine compartment is defined within the hull and an engine is mounted within the engine compartment. A tunnel is defined within a lower aft portion of the hull. A propulsion unit is preferably powered by the engine and mounted within the tunnel. A plate covers at least a portion of the tunnel proximate the propulsion unit and has a generally longitudinally-extending channel defined along at least a portion thereof. A sensor is mounted to the plate and has a moveable element that extends into the channel. A display is positioned proximate the straddle seat and communicates with the sensor.

Another aspect of the present invention involves a ride plate assembly for a personal watercraft. The ride plate assembly comprises a sensor and a plate. The sensor generally comprises a moveable element and a housing supporting at least a portion of the moveable element. The plate comprises a longitudinally-extending channel with the channel extending along at least a portion of the length of the plate. The housing is connected to an aft portion of the plate with at least a portion of the rotatable element being positioned in line with the channel.

A further aspect of the present invention involves a personal watercraft comprising a hull having a longitudinal axis. A generally longitudinally-extending elongated seat is positioned on an aft portion of the hull. An engine compartment is defined within the hull with an engine mounted within the engine compartment. A tunnel is defined within a lower aft portion of the hull and contains a propulsion unit powered by the engine. A ride plate assembly covers at least a portion of the tunnel proximate the propulsion unit and generally comprises a plate and a sensor apparatus. The sensor apparatus comprises a moveable element and a display in communication with the movable element. The display is positioned on the hull so as to be easily viewed by an operator. The ride plate assembly also comprises a means for channeling a flow of water into contact with at least a portion of the movable element of the sensor apparatus.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments of the watercraft are intended to illustrate, but not to limit the invention. The drawings contain the following figures.

DETAILED DESCRIPTION OF PREFERRED EMBODIMENTS OF THE INVENTION

Figure 1:
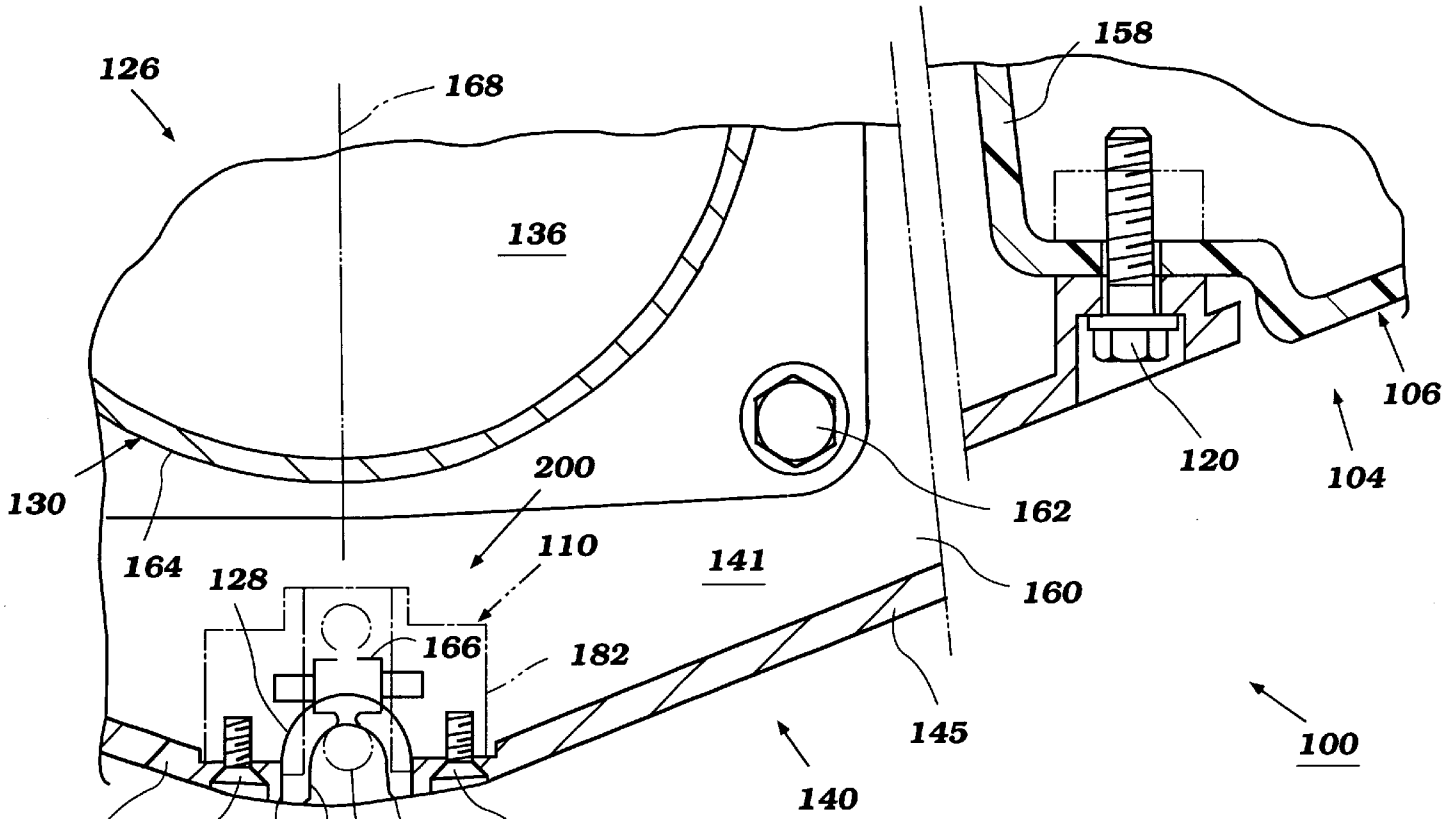
FIG. 1 is partial cross-sectional view of a personal watercraft with a speed monitoring system configured in accordance with a preferred embodiment of the present invention.
Figure 2:
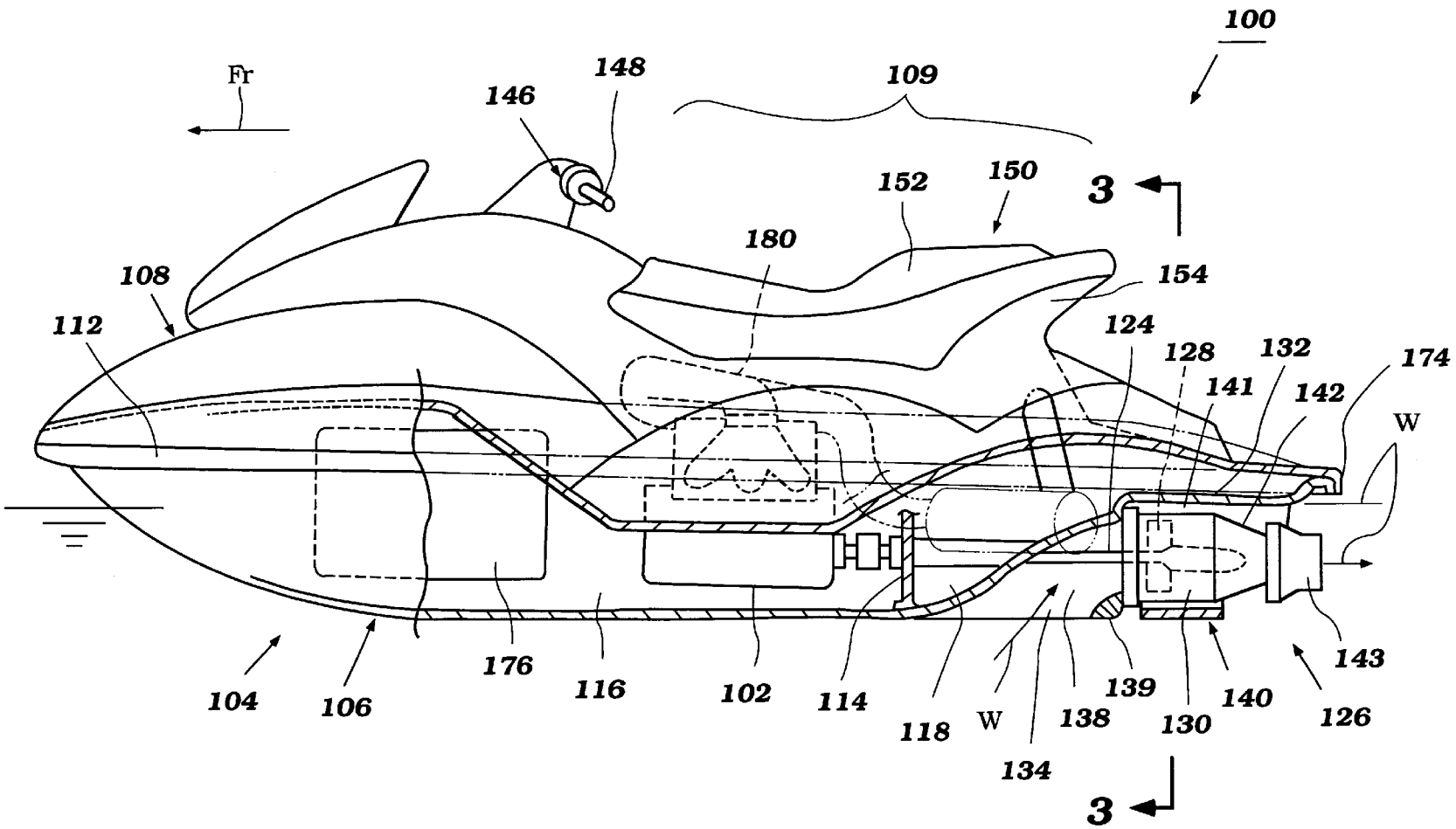
FIG. 2 is a sectional side view of the personal watercraft of FIG. 1, with various components of the watercraft illustrated in phantom.

With initial references to FIGS. 1 and 2, a portion of a small watercraft, indicated generally by the reference numeral 100, is partially illustrated in cross-section. The watercraft 100 includes an arrangement of an engine 102 and a speed monitoring system 200 mounted within a ride plate 140 of the watercraft 100 in accordance with a preferred embodiment of the present invention.

Although the present invention is illustrated and described with reference to the illustrated embodiments, various other engine types and configurations may also be used with the present invention. Moreover, it is understood that the speed monitoring system 200 can be used with other types of watercraft as well, for example, but without limitation, jet boats and the like.

The following describes the illustrated watercraft in reference to a coordinate system in order to ease the description of the watercraft. A longitudinal axis extends from bow to stem and a lateral axis from port side to starboard side normal to the longitudinal axis. In addition, relative heights are expressed in reference to the undersurface of the watercraft. And in FIG. 2, a label "$F_R$" is used to denote the direction the watercraft travels during normal forward operation.

Before describing the speed monitoring system 200 in the watercraft 100, an exemplary personal watercraft 100 will first be described in general detail to assist the reader's understanding of the environment of use. The watercraft 100 has a hull, indicated generally by reference numeral 104. The hull 104 can be made of any suitable material; however, a presently preferred construction utilizes molded fiberglass reinforced resin. The hull 104 generally has a lower hull section 106 and an upper deck section 108. A bond flange or gunnel 112 may connect the lower hull section 106 to the upper deck section 108. Of course, any other suitable means may be used to interconnect the lower hull section 106 and the upper deck section 108. Additionally, the lower hull section 106 and the upper deck section 108 may be integrally formed.

As viewed in the direction from the bow to the stem of the watercraft, the upper deck section 108 includes a control mast 146 supporting a handlebar assembly 148 and a rider's area 109. The handlebar 148 controls the steering of the watercraft 100 in a conventional manner. The handlebar assembly also carries a variety of controls of the watercraft 100, such as, for example, a throttle control, a start switch and a lanyard switch.

The rider's area 109 lies behind the control mast 146 and includes a seat assembly 150. In the illustrated embodiment, the seat assembly 150 has a longitudinally extending straddle-type seat which may be straddled by an operator and by at least one or two passengers. The seat assembly 150, at least in principal part, is formed by a seat cushion 152 supported by a raised pedestal 154. The raised pedestal 154 forms a portion of the upper deck section 108, and has an elongated shape that extends longitudinally along the center of the watercraft 100. The seat cushion 152 desirably is removably attached to a top surface of the raised pedestal 154 by one or more latching mechanisms (not shown) and covers the entire upper end of the pedestal 154 for rider and passenger comfort.

An engine access opening (not shown) is located in the upper surface of the upper deck section 108. The access opening opens into an engine compartment 116 formed within the hull 104. An engine access cover (not shown) normally covers and seals closed the engine compartment 116 in a watertight manner. When the engine access cover is removed, the engine compartment 116 of the hull 104 is accessible through the access opening.

The upper deck section 108 of the hull 104 advantageously includes a pair of level planes (not shown) positioned on opposite sides of the aft end of the upper deck section 108. The level planes define a pair of foot areas that extend generally longitudinally and parallel to the sides of the pedestal 154. In this position, the operator and any passengers sitting on the seat assembly 150 can place their feet on the foot areas during normal operation of the personal watercraft 100. A non-slip (e.g., rubber) mat desirably covers the foot areas to provide increased grip and traction for the operator and passengers.

The hull 104 also includes one or more bulkheads 114 which may be used to reinforce the hull internally and which also may serve to define, in part, the engine compartment 116 and the propulsion compartment 118. The engine 102 is mounted within the engine compartment 116 in any suitable manner. For instance, a set of resilient engine mounts (not shown) may be used to connect the engine 102 to a set of stringers (not shown). The engine is desirably mounted in a central transverse position. The engine 102 may be of any known configuration. For example, the engine 102 may be a two-stroke, four-stroke or rotary type of engine. Additionally, the engine 102 may comprise any number of cylinders. The illustrated engine is a four-stroke engine having four cylinders. The illustrated engine type, however, is merely exemplary.

Air intakes and air ducts (not shown) in the upper deck section 108 of the watercraft 100 typically allow atmospheric air to be used for cooling and combustion to enter the engine compartment 116. Except for the air ducts, the engine compartment 116 is normally substantially sealed so as to enclose the engine 102 of the watercraft 100 from the body of water in which the watercraft 100 is operated.

Figure 3:
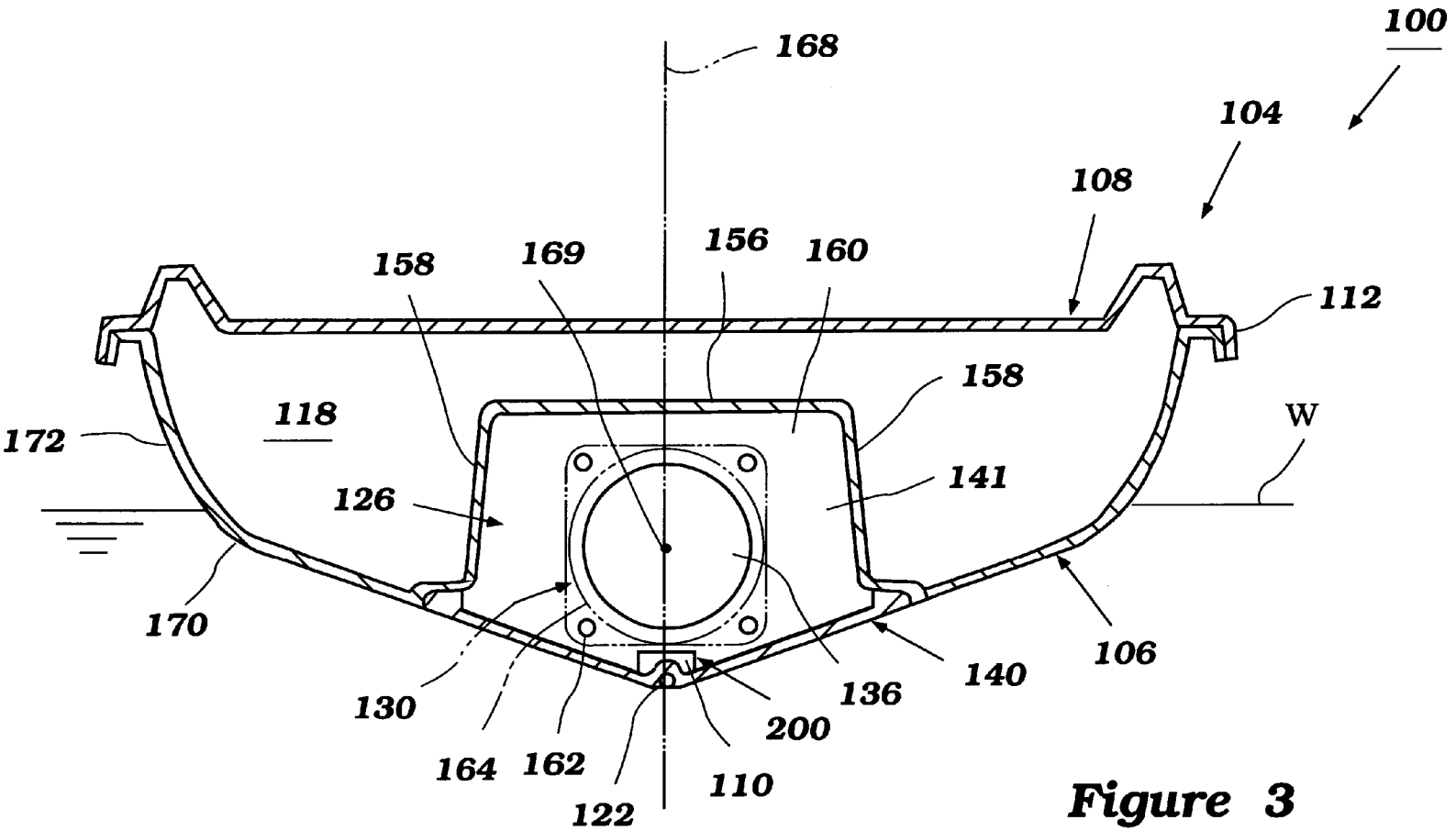
FIG. 3 is a cross-sectional view of the watercraft of FIG. 2 taken along line 3—3.
Figure 4:
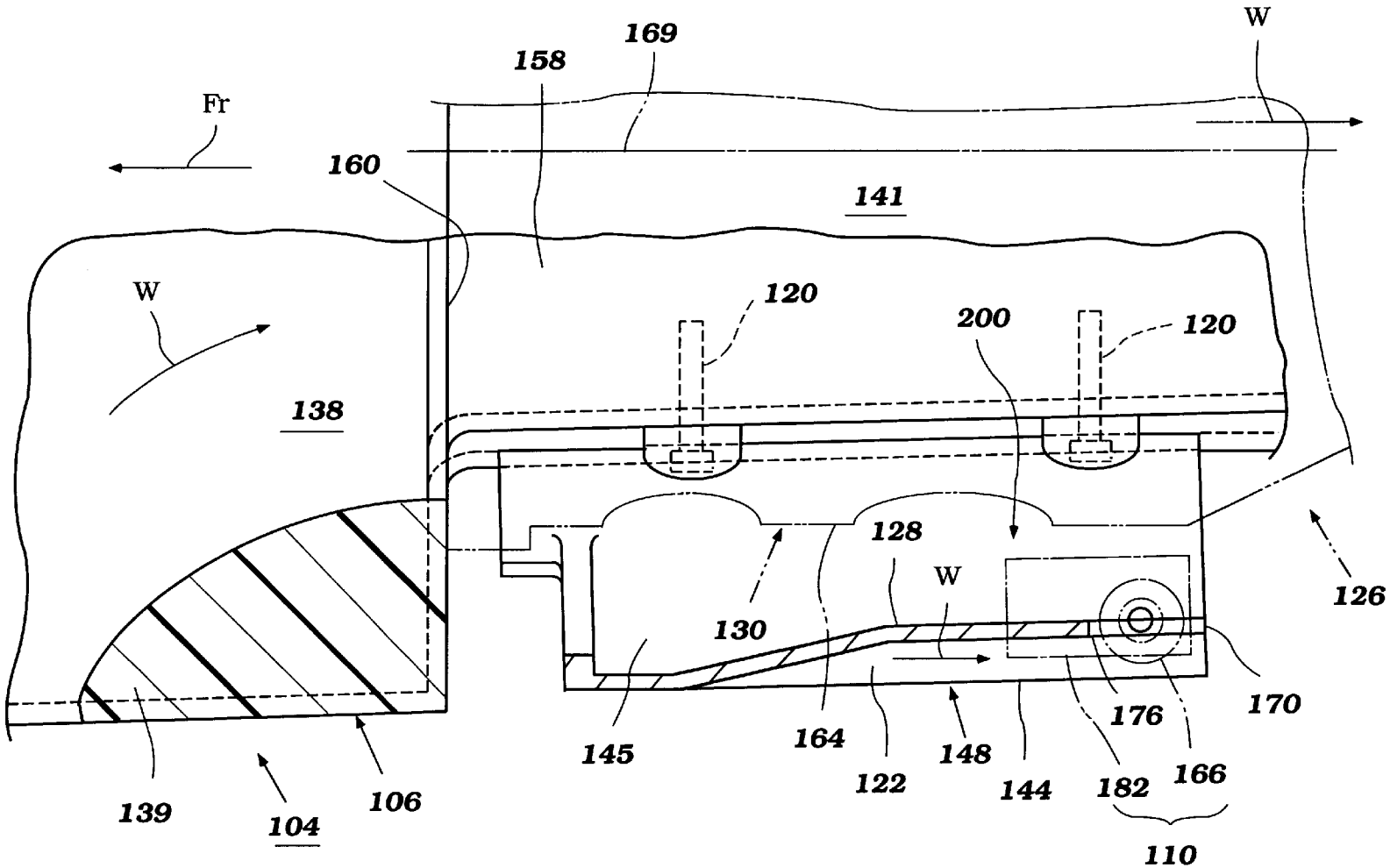
FIG. 4 is a partial sectional side view of the personal watercraft of FIG. 1, with various components of the watercraft illustrated in phantom.
Figure 5:
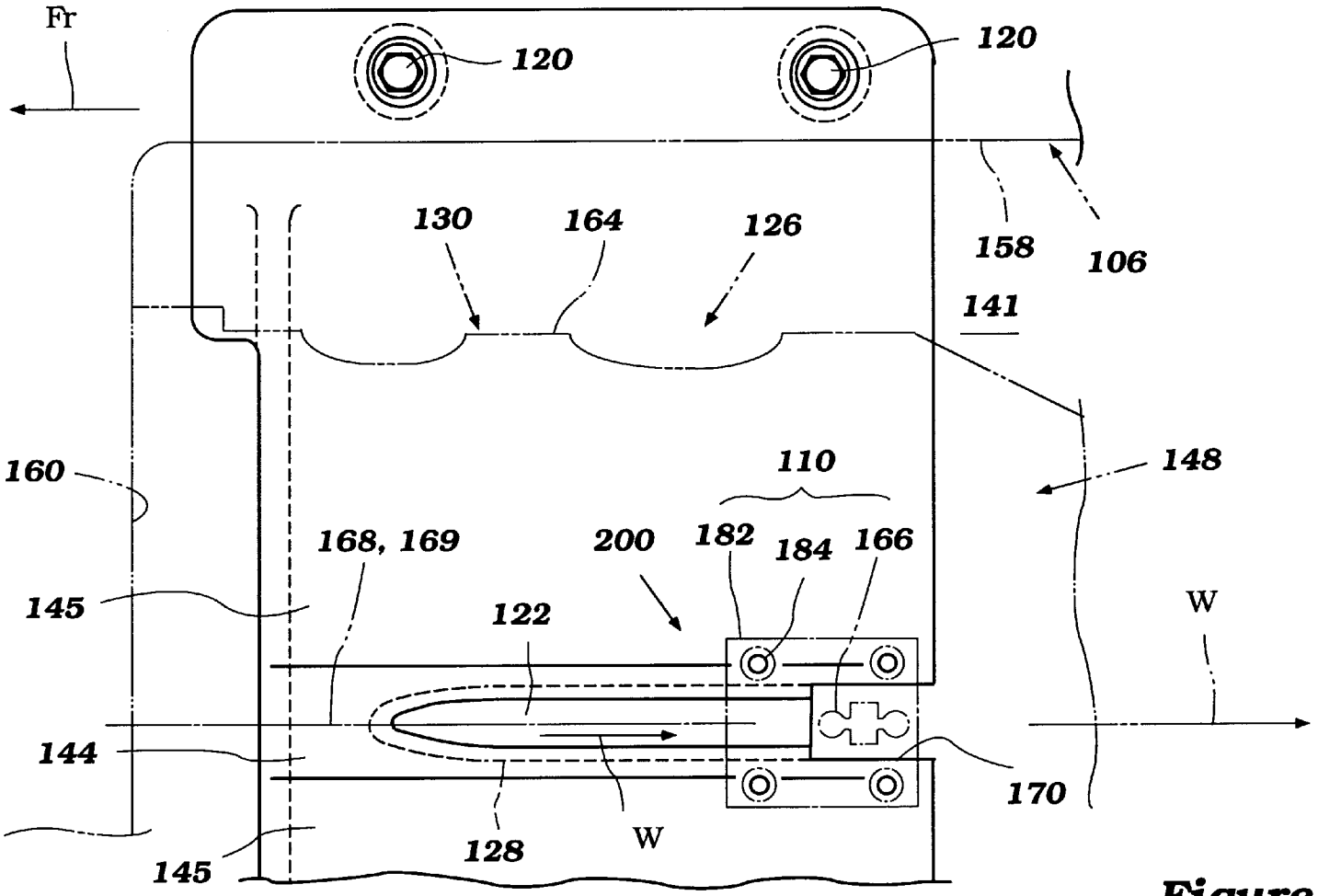
FIG. 5 is a partial top plan view of the personal watercraft of FIG. 1, with various components of the watercraft illustrated in phantom.
Figure 6:
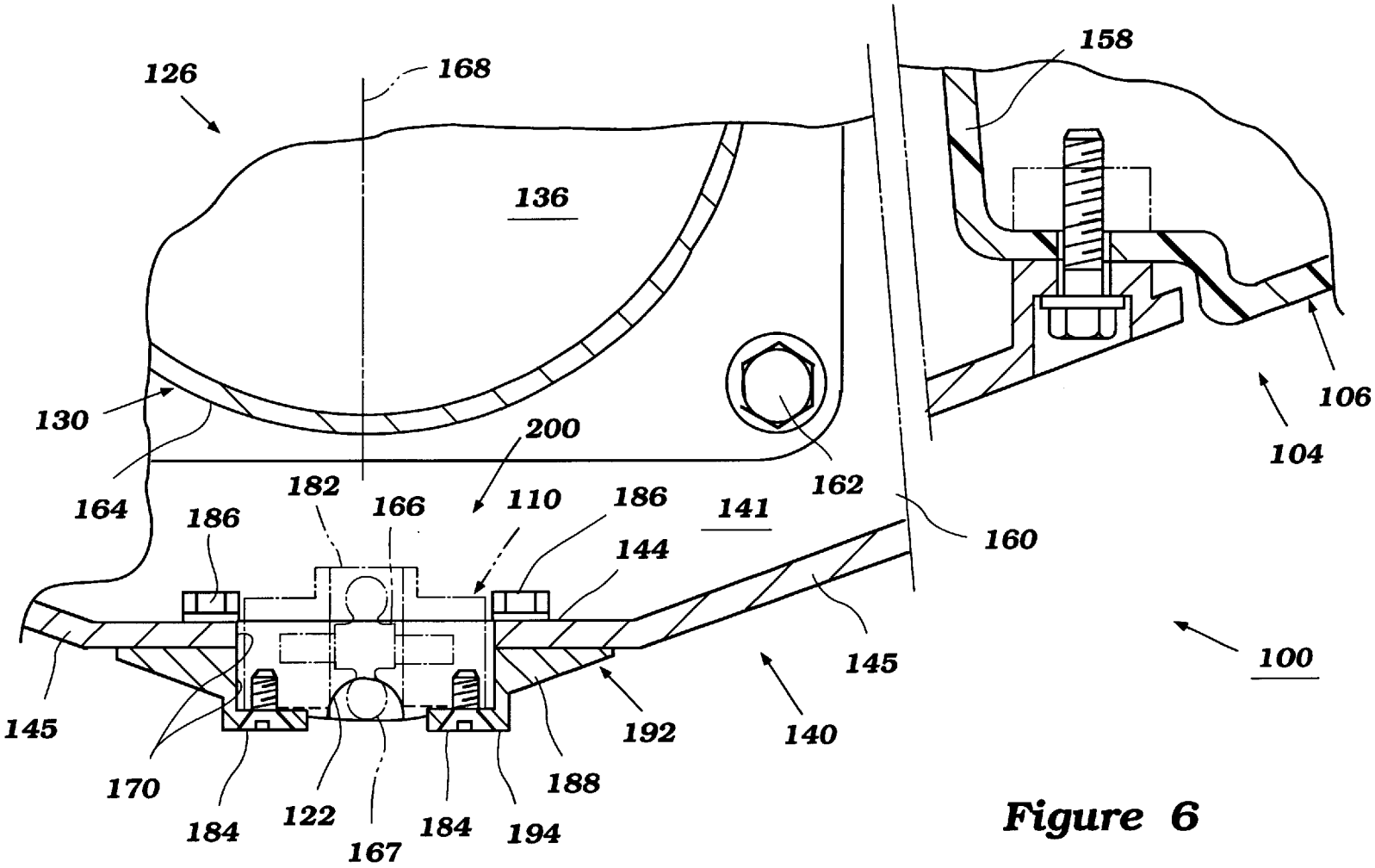
FIG. 6 is a partial cross-sectional view of a personal watercraft with a speed monitoring system configured in accordance with another embodiment of the present invention.
Figure 7:
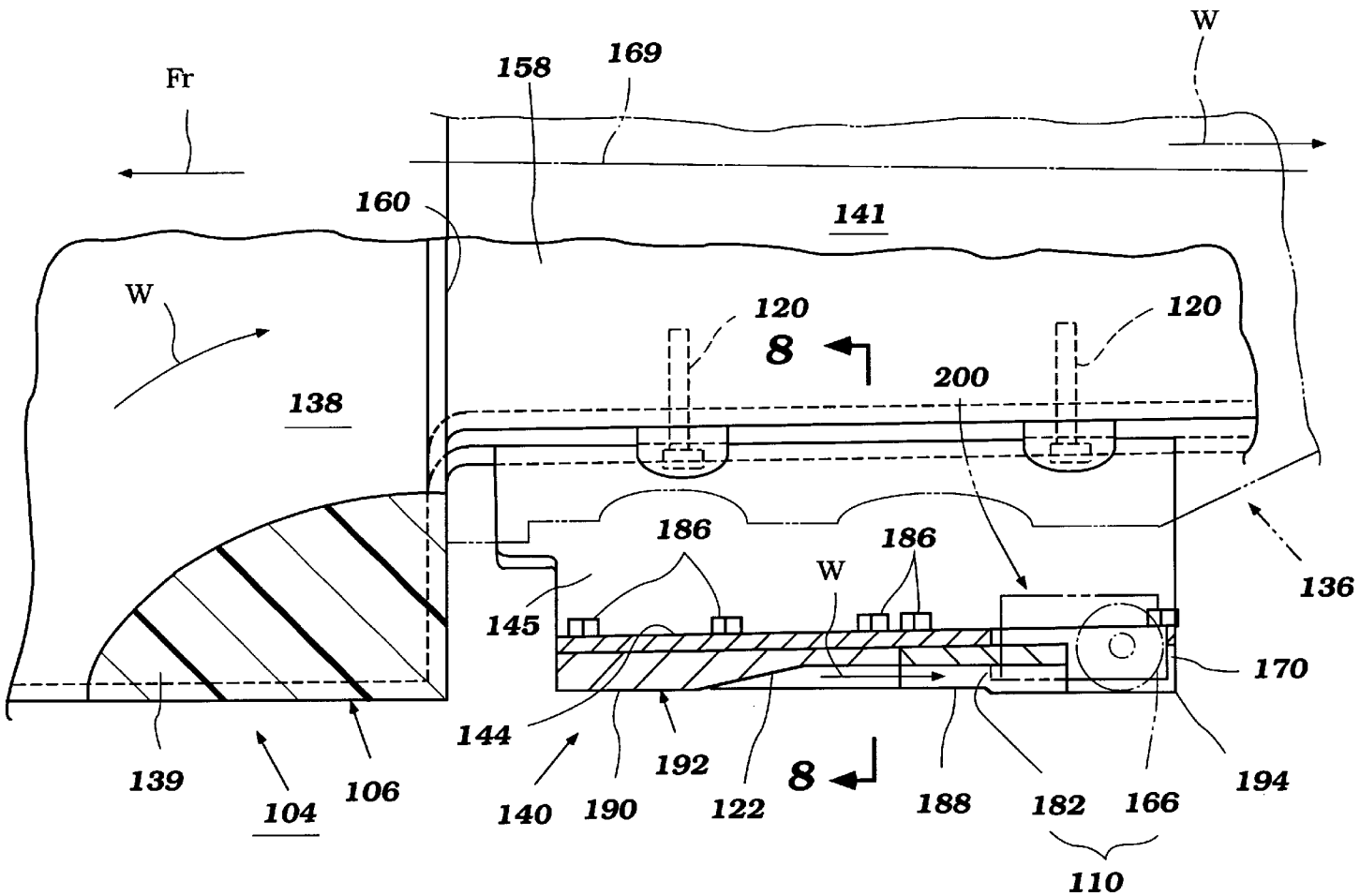
FIG. 7 is a partial sectional side view of the personal watercraft of FIG. 6, with various components of the watercraft illustrated in phantom.
Figure 8:
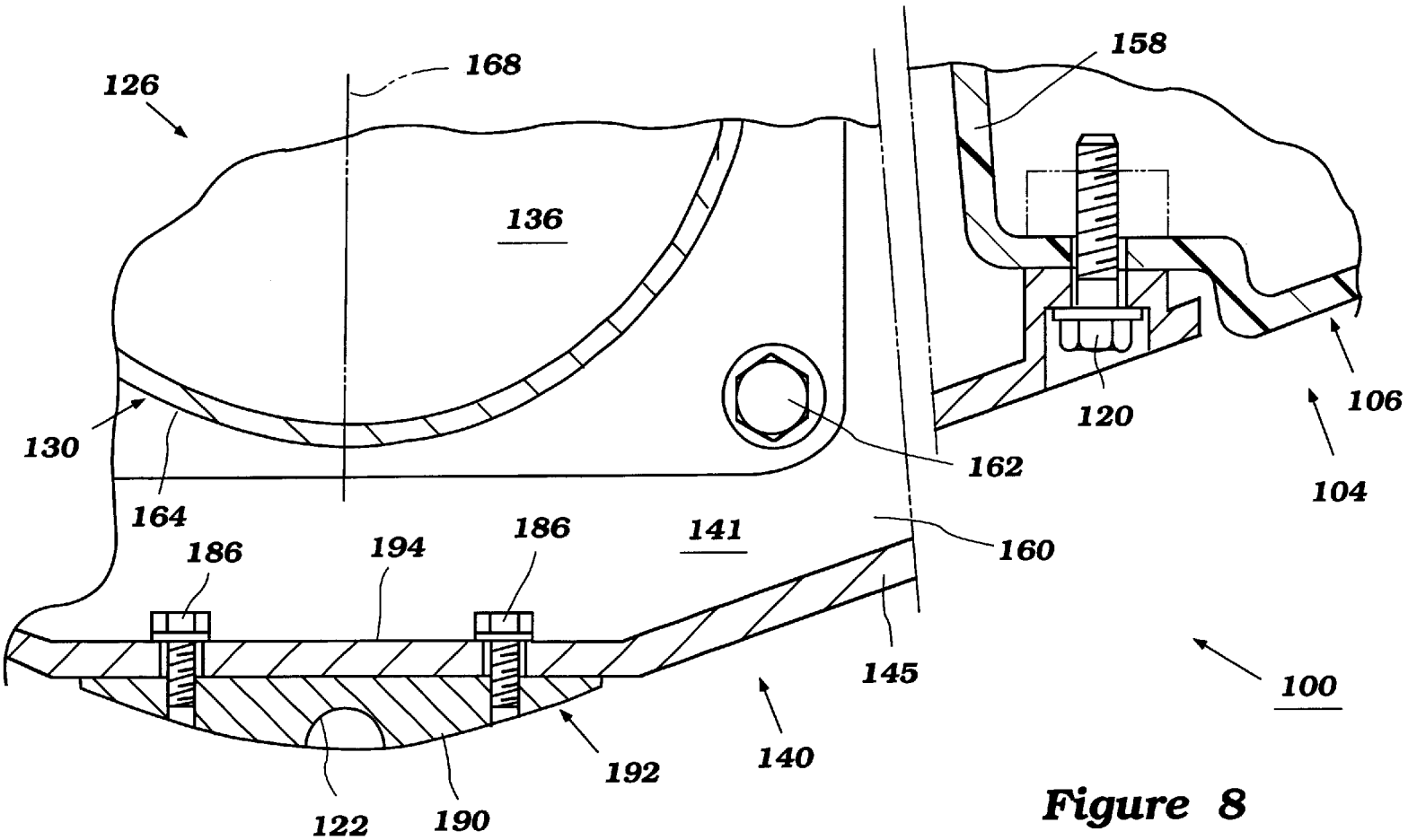
FIG. 8 is a partial cross-sectional view of the personal watercraft of FIG. 7 taken along line 8—8.
Figure 9:
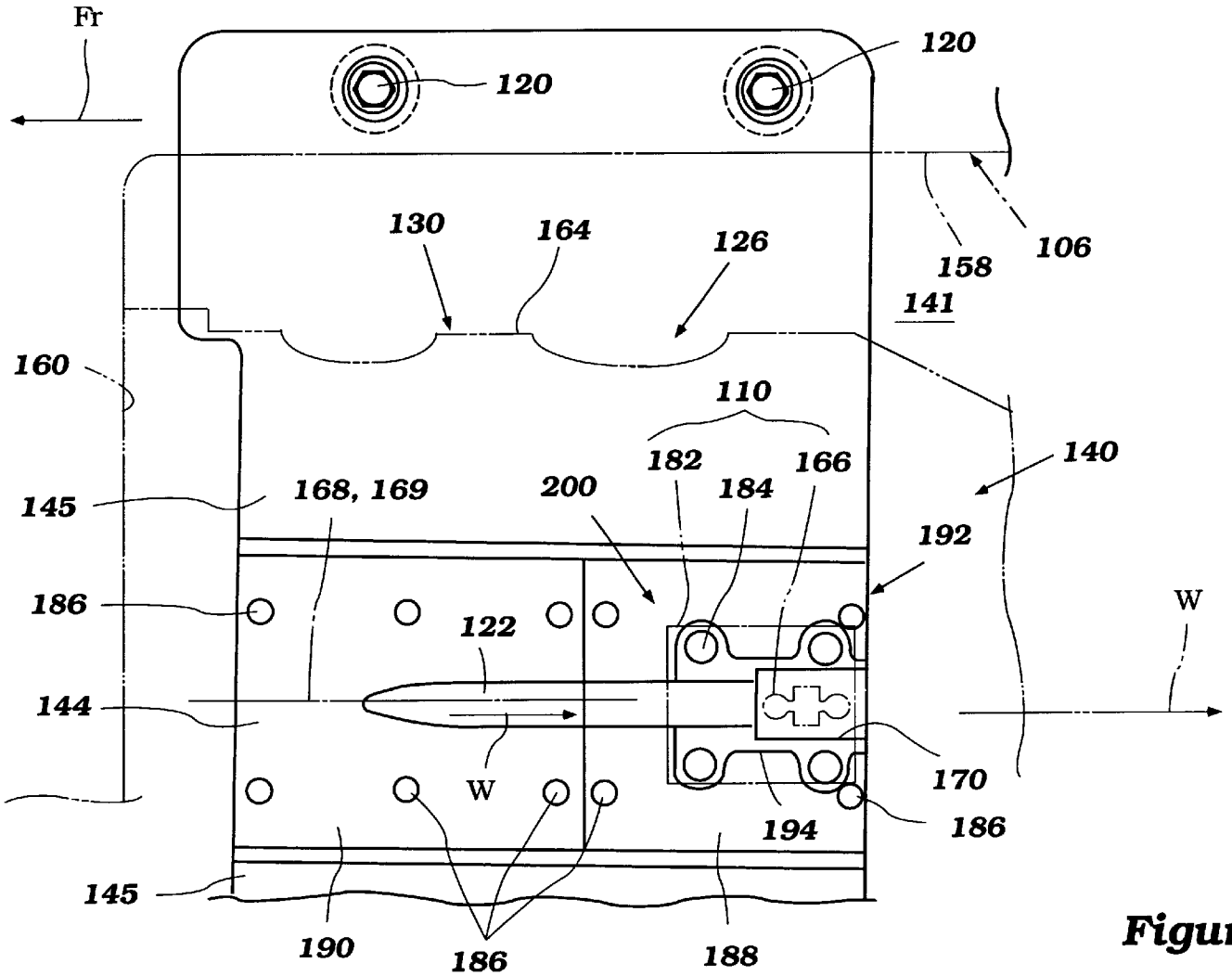
FIG. 9 is a partial top plan view of the personal watercraft of FIG. 6, with various components of the watercraft illustrated in phantom.

The lower hull section 106 is designed such that the watercraft 100 planes or rides on a minimum surface area of the aft end of the lower hull section 106 in order to optimize the speed and handling of the watercraft 100 when up on plane. For this purpose, as best seen in FIG. 3, the lower hull section 106 generally has a V-shaped configuration formed by a pair of inclined sections that extend outwardly from the keel line 168 to outer chimes 170 at a dead rise angle. The inclined sections extend longitudinally from the bow toward the transom 174 of the lower hull section 106 and extend outwardly to side walls 172 of the lower hull section 106.

The side walls 172 are generally flat and straight near the stem of the lower hull section 106 and smoothly blend towards the longitudinal center of the watercraft 100 at the bow. The lines of intersection between the inclined section and the corresponding side wall 172 form the outer chines 170 of the lower hull section 106. The lower hull section 106 can also include additional chines between the keel line 168 and the outer chines 170 for improved handling, as known in the art.

Toward the transom of the watercraft 100, the inclined sections of the lower hull section 106 extend outwardly from a recessed tunnel 132 that extends upward towards the upper deck section 108. The tunnel 132 has a generally parallelepiped shape and opens through a transom 174 of the watercraft 100.

In the illustrated embodiment, a jet pump unit 126 propels the watercraft 100. The jet pump unit 126 is mounted within the tunnel 132, formed on the underside of the lower hull section 106, by a plurality of bolts (not shown). An inlet opening 134 formed in the bottom of the hull 104 opens into a gullet 138 which leads to an impeller housing of the jet pump unit 126.

A steering nozzle 143 is supported at the downstream end of the discharge nozzle 142 by a pair of vertically extending pivot pins (not shown). In an exemplary embodiment, the steering nozzle 143 has an integral level on one side that is coupled to the handlebar assembly 148 through, for example, a bowden-wire actuator, as known in the art. In this manner, the operator of the watercraft 100 can move the steering nozzle 143 to effect directional changes of the watercraft 100.

A ride plate 140 covers a portion of the tunnel 132 behind the inlet opening 134 to enclose the jet pump unit 126 within the tunnel 132. As best seen in FIG. 1, the ride plate 140 is comprised of a center plate section 144 and opposing side plate sections 145 which extend outward from the center plate section 144. A bulge or bead 128 is secured within a cutaway section 170 of the ride plate 140. The bead 128 is desirably fastened to the ride plate 140 by welding or other fastening means well known in the art. Bolts 120 secure the ride plate 140 to the lower hull 106 with the side plate sections 145 of the ride plate 140 blending with the rear inclined sections of the lower hull 106. In this manner, the lower opening of the tunnel 132 is closed to provide a planing surface for the watercraft 100. A pump chamber 141 then is defined within the tunnel section covered by the ride plate 140.

An impeller shaft 124 supports the impeller 128 within the impeller housing 130. The aft end of the impeller shaft 124 is suitably supported and journalled within the compression chamber 136 of the housing 130 in a known manner. The impeller shaft 124 extends in a forward direction through a bulkhead 114. A protective casing surrounds a portion of the impeller shaft 124 that lies forward of the intake gullet 138.

The engine 102 powers the impeller shaft 124 about an impeller axis 169. The engine 102 is positioned within the engine compartment 116 and is mounted primarily beneath the rider's area 109. The engine is mounted in approximately the centerline of the watercraft 100.

A fuel supply system delivers fuel to the engine 102 in a manner known in the art. The fuel supply system includes a fuel tank 176 located in front of the engine 102. Although not illustrated, at least one pump desirably delivers fuel from the fuel tank 176 to the engine 102 through one or more fuel lines.

The engine 102 typically draws air from the engine compartment 116 through an engine air intake system (not shown). Although not illustrated, the engine air intake system typically comprises an engine air intake which draws air from the engine compartment 116 and supplies this air to an air intake manifold and carburetor, which supply a fuel/air charge to a plurality of engine cylinders in a known manner. Of course, other arrangements, such as direct or indirect fuel injection, could be used to provide a fuel charge to the engine 102.

The engine exhaust system 180 typically comprises an exhaust manifold which transfers exhaust gases exiting the combustion chamber to an engine exhaust pipe 180. The exhaust manifold thus generally comprises a merge chamber and a plurality of exhaust runner passages as known in the art. The engine exhaust pipe transfers exhaust gases to a watertrap. The watertrap is a well known device that allows the passage of exhaust gases, but contains baffles which prevent water from passing back through the engine exhaust pipe into the engine 102. In the present embodiment, the watertrap is located behind the engine 102. The watertrap transfers exhaust gases to a watercraft exhaust pipe. The watercraft exhaust pipe discharges the exhaust gases to the pump chamber 141 and the atmosphere. Desirably, at least one section of the watercraft exhaust pipe is positioned higher than the watertrap and the pump chamber 141, such that the passage of water W through the atmospheric exhaust pipe into the watertrap is inhibited.

As best seen in FIG. 3, the tunnel 132 in general is formed by a ceiling 156, opposing side walls 158, the ride plate 140 and a front plate 160. A water pipe 164, which forms a portion of the impeller housing 130, is secured to the front plate 160 by fasteners 164 or other means well known in the art.

As previously noted, the engine 102 desirably is an internal combustion engine of a known four-stroke variety. Because the engine is conventional, the internal details of the engine are not believed necessary for an understanding of the present speed monitoring system.

With reference to FIGS. 1–5, the speed monitoring system 200 comprises a speed sensor 110 at least partially disposed within a channel 122 formed in a lower surface of the ride plate 140. While the disclosed channel extends longitudinally along a substantial portion of the ride plate 140, it could also extend the entire length along the ride plate, with no loss of utility. In addition, while the disclosed channel 122 varies in depth along its length, if desired the channel 122 could be of a constant depth along its entire length, or could be enclosed along some or all of its length.

The speed sensor 110 comprises a sensor body 182 which is positioned over the bead 128 of the ride plate 140. The sensor body 182 is secured to the ride plate by fasteners 184 or other means well known in the art. A paddle wheel or rotator 166 is secured to the sensor body 182 by a shaft, which allows the rotator 166 to rotate freely.

The rotator 166 includes a plurality of blades 167 which extend from the hub of the rotator 166. Desirably, the hub rotates about an axis transverse to the forward motion $F_R$ of the watercraft 100, although other orientations could be used, if desired. Each blade is sized such that the tip of the blade 167 extends through an opening 176 formed in the bead 128. In the disclosed embodiment, the blade does not extend beyond the channel 122, however, if desired the blade could extend beyond the channel 122 and/or below the bottom surface of the ride plate 140. Each blade 167 is configured principally for rotation in a water flow moving along the longitudinal axis of the watercraft 100.

The speed sensor 110 also includes a rotation detector (not shown) that is used to determine the rotational speed of the rotator 166. By way of example, and not by limitation, the rotational detector could include a "hall-effect" transducer that cooperates with the blades 167 of the rotator 166, such as disclosed in U.S. Pat. No. 5,699,749 to Yamada, which is incorporated by reference herein. For this purpose, the blades 167 of the rotator would desirably be made of a magnetic material and are alternately polarized. The paddle wheel would thus include an even number of blades. When the rotator 166 is rotated, the transducer produces a signal which can be used to determine the speed of the watercraft.

When the watercraft is operating in the forward direction $F_R$, water W will flow past a lower hull portion 139 and the ride plate 140. This water W tends to enter the channel 122, and travels longitudinally along the channel 122 and past the speed sensor 110. Because the blades 167 of the rotator 166 extend into the channel 122, this motion of the water W will interact with the blades 167, spinning the rotator 166.

Because the channel 122 is positioned on the underside of the ride plate 140, desirably on the keel line 168 of the watercraft 100, the channel 122 will typically be in contact with and/or submerged under water W. Consequently, during forward operation of the watercraft 100, water W will continually pass through the channel 122, even when the watercraft 100 undergoes violent maneuvers and/or high-speed turns. In addition, the length of the channel improves the accuracy of the speed sensor 110 by isolating the sensor 110 from disturbances in the water W caused by the passage of the watercraft 100. Thus, the disclosed speed monitoring system 200 provides consistently accurate speed data to the operator of the watercraft during all aspects of watercraft operation.

FIGS. 6–9 illustrate another embodiment of a speed monitoring system 200 within a small watercraft 100 in accordance with a preferred embodiment of the present invention. The principal differences between the embodiment of FIGS. 1–5 and the embodiment of FIGS. 6–9 lie with the positioning and arrangement of the speed monitoring system on the ride plate 140 of the watercraft hull 104. Therefore, for ease of description, similar features are ascribed the same reference numerals used for corresponding elements from the embodiments of FIGS. 1–5. Unless otherwise indicated, the above description of similar components should be understood as applying equally to the following embodiment.

As with the first embodiment, while the watercraft is operating in the forward direction $F_R$, water W will desirably pass through the channel 122. In the embodiment shown in FIGS. 6–9, the speed monitoring system 200 comprises a speed sensor 110 at least partially disposed within a channel 122. However, in this embodiment, the center plate section 144 of the ride plate 140 is wider than that of the previously disclosed embodiment. In addition, in this embodiment, a liner plate 192 is secured to the underside of the ride plate 140 by fasteners 186 or other means well known in the art.

The liner plate 192 comprises a rear plate 188 and a front plate 190. As previously noted, the rear plate is secured to the underside of the ride plate 140 by fasteners 186. Similarly, the front plate 190 is secured to the underside of the ride plate 140 by fasteners 186, at a location forward of the rear plate 188. A portion of the channel 122 is formed in the underside of each plate 188, 190. As can best be seen from FIGS. 7 and 9, the front and rear plates 190, 188 are desirably in contact with each other, such that they form the channel 122 which extends longitudinally along the underside of the skid plate 140.

The speed sensor 110 comprises a sensor body 182, and a rotator 166, with a portion of the rotator 166 extending into the portion of the channel 122 formed in the rear plate 188. The sensor body 182 is secured to flanges 194 of the liner plate 192 by fasteners 184. As with the embodiment of FIGS. 1-5, the rotator 166 includes a plurality of blades 167 which extend from the hub of the rotator 166. Each blade is sized such that the tip of the blade 167 extends into the channel 122. Each blade 167 is configured principally for rotation in a water flow moving along the longitudinal axis of the watercraft 100. The speed sensor 110 also includes a rotation detector (not shown) that is used to determine the rotational speed of the rotator 166, such as the previously-described "hall-effect" transducer.

This embodiment allows the speed monitoring system to be utilized with watercraft having little or no clearance above the ride plate 140. By extending the speed sensor through the ride plate 140, and securing the speed sensor 110 to the liner plate 192, the present embodiment eliminates the need for substantial clearance between the ride plate 140 and the water pipe 164. In addition, the incorporation of the liner plate 192 assists the ride plate 140 in supporting the weight of the watercraft 100 when up on plane.

As with the previously-described embodiment, when the watercraft is in operation in the forward direction $F_R$, water W will flow through the channel 122 and will activate the speed sensor 110. Consequently, during forward operation of the watercraft 100, water W will continually pass through the channel 122, even when the watercraft 100 undergoes violent maneuvers and/or high-speed turns.

Figure 10:
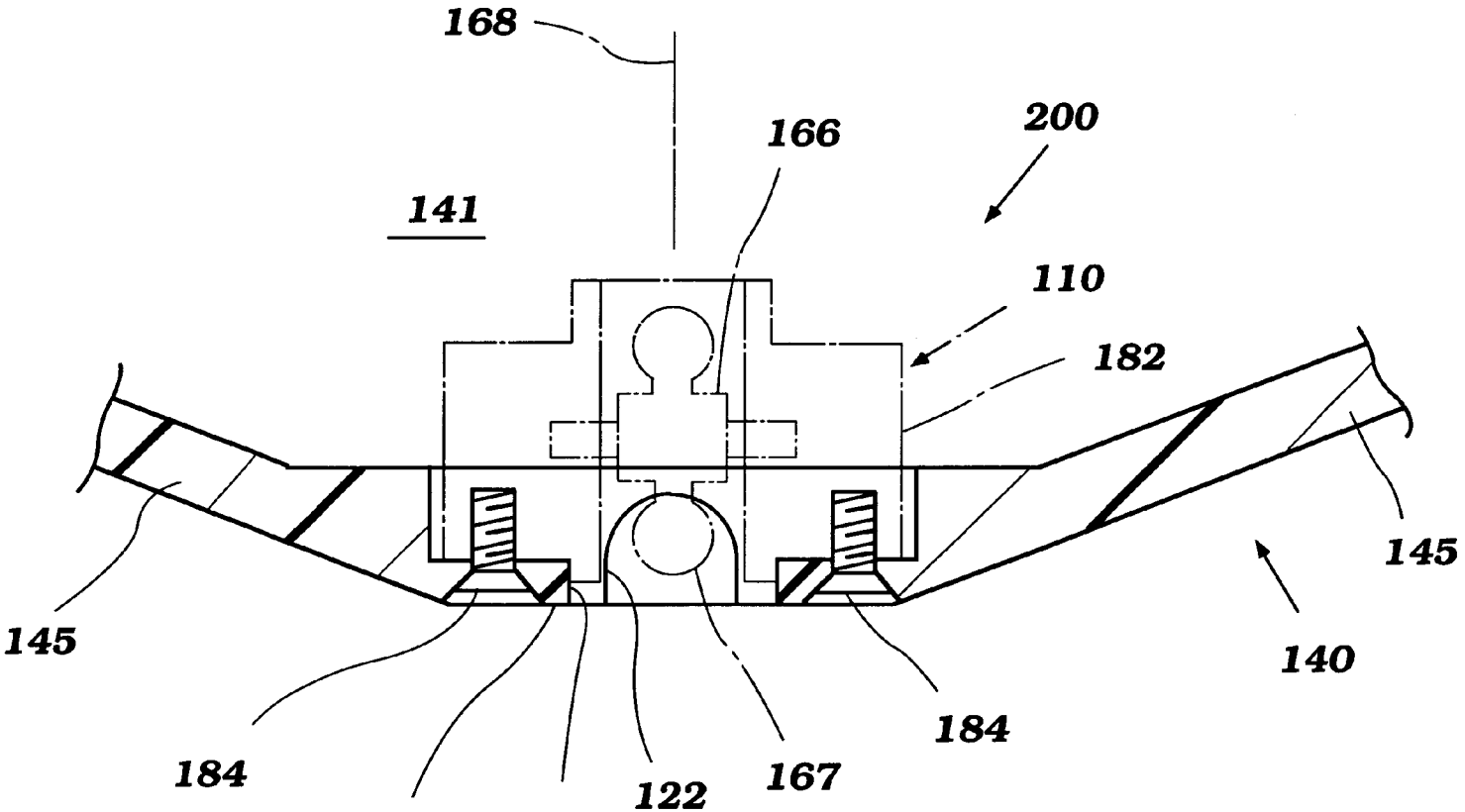
FIG. 10 is a partial cross-sectional view of a personal watercraft with a speed monitoring system configured in accordance with another embodiment of the present invention.

FIG. 10 illustrates another embodiment of a speed monitoring system 200 in a small watercraft 100 in accordance with a preferred embodiment of the present invention. The principal differences between the present embodiment and the embodiment of FIGS. 1–5 lie with the positioning and arrangement of the speed monitoring system on the ride plate 140 of the watercraft hull 104. Therefore, for ease of description, similar features are ascribed the same reference numerals used for corresponding elements from the embodiments of FIGS. 1–5. Unless otherwise indicated, the above description of similar components should be understood as applying equally to the following embodiment.

As with the first embodiment, while the watercraft is operating in the forward direction $F_R$, water W will desirably pass through the channel 122. In the embodiment shown in FIG. 10, the speed monitoring system 200 comprises a speed sensor 110 at least partially disposed within a channel 122 formed in a lower surface of the ride plate 140 of the watercraft 100. In this embodiment, the center plate section 144 of the ride plate 140 is thicker than that of the embodiment of FIGS. 1–5. This increased thickness of the center plate section 144 permits the channel 122 to be formed in the ride plate 140 without significantly weakening the ability of the ride plate to support the planing watercraft. The speed sensor 110 fits into a recess formed in the upper surface of the ride plate 140.

By forming the channel 122 within the ride plate 140 in the disclosed manner, the present embodiment significantly reduces the complexity of the present speed monitoring system without sacrificing the strength of the ride plate 140. In a similar manner, if desired, the ride plate 140 of FIGS. 1–5 could similarly be strengthened by increasing the thickness of the ride plate 140, or by forming a channel 122 in a projection which extends downward from the ride plate 140.

As with the previously described embodiments, the positioning and arrangement of the disclosed speed monitoring system provides the watercraft operator with accurate speed data during high speed operation of the watercraft and during violent maneuvers and/or high-speed turns.

Although this invention has been described in terms of certain embodiments, other embodiments apparent to those of ordinary skill in the art also are within the scope of this invention. Thus, various changes and modifications may be made without departing from the spirit and scope of the invention. For example, various combinations of the preferred embodiments are possible. Accordingly, the scope of the invention is intended to be defined only by the claims that follow.

What is claimed is:

1. A small watercraft comprising a hull having a longitudinal axis, an engine compartment defined within the hull, an engine mounted within the engine compartment, a tunnel defined within a lower aft portion of the hull, a propulsion unit powered by the engine, the propulsion unit mounted within the tunnel, a plate covering at least a portion of the tunnel proximate the propulsion unit, a lower surface of the plate defining a planing surface upon which the watercraft rides when the watercraft is planing, a generally longitudinally-extending channel defined along at least a portion of the plate, longitudinally extending first and second portions extending adjacent the channel, the first and second portions having respective lower surfaces disposed lower than the planing surface, a sensor mounted to the plate, the sensor having a moveable element, the movable element extending into the channel and arranged so as to be higher than the lower surfaces of the first and second portions, and a display positioned proximate a seat and in communication with the sensor.

2. The small watercraft of claim 1, wherein the display is capable of displaying a reading reflecting the speed of the personal watercraft.

3. The small watercraft of claim 1, wherein the plate comprises a lower surface and the channel is formed within the lower surface.

4. The small watercraft of claim 3, wherein the movable element does not extend below the lower surface of the plate.

5. The small watercraft of claim 1, wherein the sensor is mounted to an aft portion of the plate.

6. The small watercraft of claim 1, wherein the plate comprises a first length and the channel comprises a second length such that the first length is greater than the second length.

7. The small watercraft of claim 6, wherein the channel has an increasing depth over at least a portion of the second length.

8. The small watercraft of claim 7, wherein the channel has a substantially constant depth over at least a portion of the second length.

9. The small watercraft of claim 1, wherein the channel has a center plane, the center plane being positioned along a vertical plane that extends through an axis of rotation of the propulsion unit.

10. The small watercraft of claim 1, wherein the channel is formed in a separate block secured to the plate.

11. The small watercraft of claim 1, wherein the movable element rotates about an axis that is generally transverse to the longitudinal axis.

12. The small watercraft of claim 1, wherein the channel is open along its entire length.

13. The small watercraft of claim 1, wherein at least a portion of the planing surface is substantially planar.

14. The small watercraft of claim 1, wherein the first and second portions comprise thickened portions of the plate.

15. The small watercraft of claim 1, wherein the channel is defined between the first and second portions.

16. The small watercraft of claim 1, wherein the first and second portions comprise a liner plate.

17. The small watercraft of claim 16, wherein the liner plate is configured to assist the plate in supporting a weight of the watercraft when up on plane.

18. The small watercraft of claim 1 additionally comprising a generally longitudinally-extending elongated seat positioned on an aft portion of the hull.

19. A ride plate assembly for a small watercraft, the ride plate assembly comprising a sensor and a plate, the sensor comprising a moveable element and a housing supporting at least a portion of the moveable element, the plate comprising an upper surface having a recess defined therein and comprising a longitudinally-extending channel, the channel extending along at least a portion of the length of the plate, the housing connected to an aft portion of the plate, and at least a portion of the rotatable element being positioned in line with the channel, the housing secured within the recess.

20. The ride plate assembly of claim 19, wherein the channel is integrally formed with the plate.

21. The ride plate assembly of claim 13, wherein the channel does not have a surface extending vertically below a lower surface of the plate.

22. The ride plate assembly of claim 13, wherein the channel is open along its entire length.

23. The ride plate assembly of claim 13, wherein the plate further comprises an opening and the housing is positioned at least partially within the opening.

24. A ride plate assembly for a small watercraft, the ride plate assembly comprising a sensor and a plate, the sensor comprising a moveable element and a housing supporting at least a portion of the moveable element, the plate comprising a longitudinally-extending channel, the channel extending along at least a portion of the length of the plate, the housing connected to an aft portion of the plate, and at least a portion of the rotatable element being positioned in line with the channel, wherein the ride plate assembly further comprises a mounting fixture secured on a lower surface of the plate with the housing secured to the plate by the mounting fixture.

25. The ride plate assembly of claim 24, wherein the mounting fixture is secured to the lower surface of the plate with threaded fasteners having a head positioned adjacent to an upper surface of the plate.

26. A small watercraft comprising a hull having a longitudinal axis, an engine compartment defined within the hull, an engine mounted within the engine compartment, a tunnel defined within a lower aft portion of the hull, a propulsion unit powered by the engine, the propulsion unit mounted within the tunnel, a ride plate assembly covering at least a portion of the tunnel proximate the propulsion unit, the ride plate assembly comprising a plate and a sensor apparatus, the plate having a lower surface defining a planing surface upon which the watercraft rides when planing, the sensor apparatus comprising a moveable element, a display in communication with the movable element and positioned on the hull so as to be easily viewed by an operator, the plate assembly also comprising means for defining longitudinally extending portions which define a channel therebetween for channeling a flow of water into contact with at least a portion of the movable element of the sensor apparatus, the means for defining being disposed below the planing surface of the plate.

27. The small watercraft of claim 21, wherein the moveable element rotates about an axis.

28. The small watercraft of claim 22, wherein the moveable element axis is generally transverse to the means for channeling a flow of water.

29. The small watercraft of claim 21, wherein the means for channeling a flow of water is at least partially formed on the plate.

30. The small watercraft of claim 24, wherein the means for channeling a flow of water is formed separately from the sensor apparatus.

* * * * *